US010760469B2

(12) United States Patent
Vajapeyazula et al.

(10) Patent No.: US 10,760,469 B2
(45) Date of Patent: Sep. 1, 2020

(54) V-BAND RADIATION HEAT SHIELD

(71) Applicant: CUMMINS EMISSION SOLUTIONS INC., Columbus, IN (US)

(72) Inventors: Uma Vajapeyazula, Columbus, IN (US); Richard J. Gustafson, Columbus, IN (US); Harpreet Patpatia, Greenwood, IN (US); Ryan R. Welch, Wauwatosa, WI (US)

(73) Assignee: Cummins Emission Solutions Inc., Columbus, IN (US)

( * ) Notice: Subject to any disclaimer, the term of this patent is extended or adjusted under 35 U.S.C. 154(b) by 0 days.

(21) Appl. No.: 16/470,774

(22) PCT Filed: Dec. 20, 2017

(86) PCT No.: PCT/US2017/067634

§ 371 (c)(1),
(2) Date: Jun. 18, 2019

(87) PCT Pub. No.: WO2018/119093

PCT Pub. Date: Jun. 28, 2018

(65) Prior Publication Data

US 2019/0338692 A1 Nov. 7, 2019

Related U.S. Application Data

(60) Provisional application No. 62/436,864, filed on Dec. 20, 2016.

(51) Int. Cl.
*F01N 13/14* (2010.01)
*F01N 13/18* (2010.01)

(52) U.S. Cl.
CPC ..... *F01N 13/143* (2013.01); *F01N 13/1844* (2013.01)

(58) Field of Classification Search
CPC ..... F01N 13/143; F01N 13/1844
USPC ..... 422/168; 29/890
See application file for complete search history.

(56) References Cited

U.S. PATENT DOCUMENTS

| | | | |
|---|---|---|---|
| 3,675,398 | A | 7/1972 | Giarrizzo |
| 3,863,445 | A | 2/1975 | Heath |
| 4,159,043 | A | 6/1979 | James |
| 5,849,250 | A | 12/1998 | Timko |
| 2007/0084199 | A1 | 4/2007 | Whitaker |
| 2014/0260195 | A1 | 9/2014 | McAlister |

OTHER PUBLICATIONS

International Search Report and Written Opinion from corresponding PCT Application No. PCT/US2017/067634, dated Feb. 26, 2018, pp. 1-8.

*Primary Examiner* — Tom P Duong
(74) *Attorney, Agent, or Firm* — Foley & Lardner LLP

(57) ABSTRACT

An aftertreatment system can include a radiation shield for reducing and/or redirecting radiative thermal energy. The aftertreatment system can include a first housing, a second housing, a first aftertreatment component, and the radiation shield. The first aftertreatment component is positioned within one of a first interior volume of the first housing or a second interior volume of the second housing. The radiation shield includes an attachment portion and a thermal barrier portion. The attachment portion is coupled to an exterior of the first housing or the second housing. The thermal barrier portion is structured to divert radiative thermal energy in a second direction different than a source direction of the radiative thermal energy.

20 Claims, 5 Drawing Sheets

V-BAND RADIATION HEAT SHIELD

CROSS REFERENCE TO RELATED APPLICATIONS

This application is a U.S. national stage of PCT Application No. PCT/US2017/067634, filed Dec. 20, 2017, which claims priority to and benefit of U.S. Provisional Patent Application No. 62/436,864, filed Dec. 20, 2016 and entitled "V-Band Radiation Heat Shield," the entire disclosure of which is incorporated herein by reference.

TECHNICAL FIELD

The present application relates generally to the field of aftertreatment systems for internal combustion engines.

BACKGROUND

For internal combustion engines, such as diesel engines, nitrogen oxide ($NO_x$) compounds may be emitted in the exhaust. To reduce $NO_x$ emissions, a selective catalytic reduction (SCR) process may be implemented to convert the $NO_x$ compounds into more neutral compounds, such as diatomic nitrogen, water, or carbon dioxide, with the aid of a catalyst and a reductant. The catalyst may be included in a catalyst chamber of an exhaust system, such as that of a vehicle or power generation unit. A reductant, such as anhydrous ammonia or urea, is typically introduced into the exhaust gas flow prior to the catalyst chamber. To introduce the reductant into the exhaust gas flow for the SCR process, an SCR system may dose or otherwise introduce the reductant through a doser that vaporizes or sprays the reductant into an exhaust pipe of the exhaust system upstream of the catalyst chamber. The SCR system may include one or more sensors to monitor conditions within the exhaust system.

SUMMARY

Implementations described herein relate to aftertreatment systems that include a radiation shield for reducing and/or redirecting radiative heat transfer emanating from the aftertreatment system.

One implementation relates to an aftertreatment system that includes a first housing, a second housing, a first aftertreatment component, and a radiation shield. The first housing has a first upstream end and a first downstream end and defines a first interior volume. The second housing has a second upstream end and a second downstream end and defines a second interior volume. The second upstream end is coupled to the first downstream end of the first housing to fluidly couple the first interior volume to the second interior volume. The first aftertreatment component is positioned within one of the first interior volume of the first housing or the second interior volume of the second housing. The radiation shield includes an attachment portion and a thermal barrier portion. The attachment portion is coupled to at least one of an exterior of the first housing or an exterior of the second housing, and the thermal barrier portion diverts radiative thermal energy in a second direction different than a source direction of the radiative thermal energy.

In some implementations, the thermal barrier portion includes an open end opposite the attachment portion when the attachment portion is coupled to the at least one of an exterior of the first housing or an exterior of the second housing. The second upstream end of the second housing may be coupled to the first downstream end of the first housing by a v-band clamp. In some instances, the radiative thermal energy is emitted by the v-band clamp. In some implementations, the first housing and the second housing are not insulated at a location where the second upstream end of the second housing is coupled to the first downstream end of the first housing. The aftertreatment system may further include a sensor assembly mounted to at least one of the first housing and the second housing, and the second direction for the diverted radiative thermal energy is away from the sensor assembly. The thermal barrier portion may include an open end opposite the attachment portion when the attachment portion is coupled to the at least one of an exterior of the first housing or an exterior of the second housing, and the open end opens away from the sensor assembly. In some implementations, the thermal barrier portion is offset from at least one of an exterior of the first housing or an exterior of the second housing to form an air gap insulation volume. In some instances, the first housing, the second housing, the first aftertreatment component, and the radiation shield are part of a single module aftertreatment system. In some instances, the first aftertreatment component is positioned within the first interior volume of the first housing and the attachment portion of the radiation shield is coupled to the exterior of the first housing.

Another implementation relates to an apparatus that includes an aftertreatment system with a housing and a radiation shield. The radiation shield has an attachment portion and a thermal barrier portion. The attachment portion is coupled to an exterior of the housing. The thermal barrier portion diverts radiative thermal energy in a second direction different than a source direction of the radiative thermal energy.

In some implementations, the aftertreatment system includes an aftertreatment component positioned within an interior volume of the housing. The thermal barrier portion may include an open end opposite the attachment portion when the attachment portion is coupled to the housing. The aftertreatment system may include an attachment component that emits at least part of the radiative thermal energy. The attachment component may be a v-band clamp. The apparatus may further include a sensor assembly mounted to the housing, and the second direction for the diverted radiative thermal energy is away from the sensor assembly. The thermal barrier portion may be offset from the housing to form an air gap insulation volume.

In yet another implementation, an aftertreatment system may include a first housing, a second housing coupled to the first housing via an attachment component, a first aftertreatment component positioned within one of the first housing or the second housing, and a radiation shield. The radiation shield has an attachment portion and a thermal barrier portion. The attachment portion is coupled to at least one of an exterior of the first housing or an exterior of the second housing. The thermal barrier portion diverts radiative thermal energy in a second direction different than a source direction of the radiative thermal energy.

In some implementations, the thermal barrier portion can include an open end opposite the attachment portion when the attachment portion is coupled to the at least one of an exterior of the first housing or an exterior of the second housing. The first housing, the second housing, the first aftertreatment component, and the radiation shield may be part of a single module aftertreatment system.

BRIEF DESCRIPTION

The details of one or more implementations are set forth in the accompanying drawings and the description below.

Other features, aspects, and advantages of the disclosure will become apparent from the description, the drawings, and the claims, in which:

Figure 1:
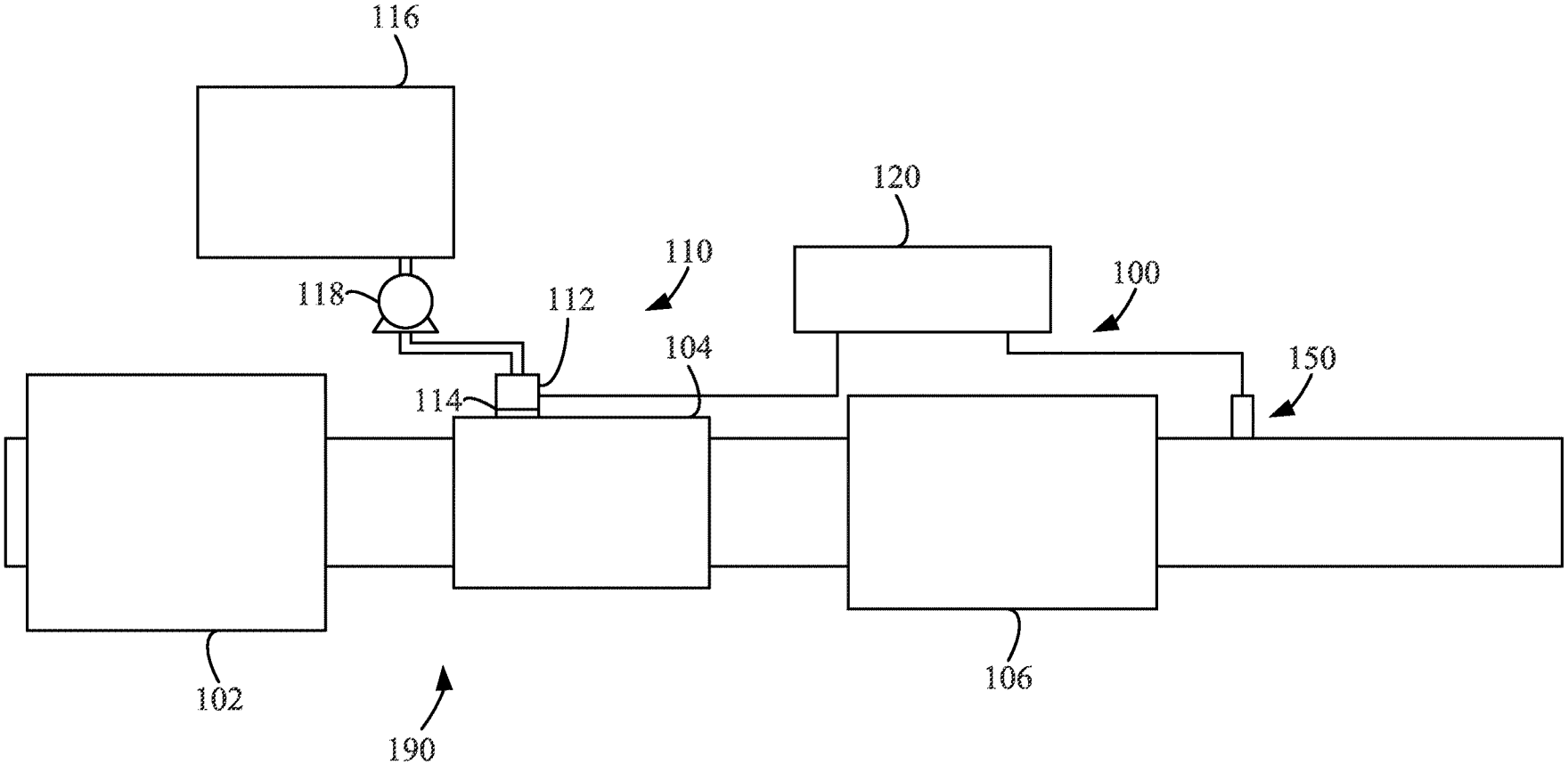
FIG. 1 is a block schematic diagram of an example selective catalytic reduction system having an example reductant delivery system for an exhaust system.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and systems for radiation shields for an aftertreatment system. The various concepts introduced above and discussed in greater detail below may be implemented in any of numerous ways, as the described concepts are not limited to any particular manner of implementation. Examples of specific implementations and applications are provided primarily for illustrative purposes.

I. Overview

An aftertreatment systems can include a radiation shield for reducing and/or redirecting radiative heat transfer emanating from the aftertreatment system. In certain implementations, the aftertreatment system includes one or more sensor assemblies that include components for one or more sensors, such as control circuitry, communication circuitry, sensors themselves, etc. The sensor assemblies can be mounted to an exterior of a housing of the aftertreatment system. For instance, a sensor table may be mounted via attachment members, such as bolts, screws, clamps, clips, etc., to the housing of the aftertreatment system for the one or more sensor assemblies to be mounted. In other implementations, the sensor assemblies may be directly coupled to the housing. In some instances, the housing may include insulating material inside and/or outside the housing to reduce heat transfer from the hot exhaust gas travelling within the aftertreatment system to the sensor table and/or sensor assemblies.

In some implementations, the aftertreatment system may include a second housing coupled to the first housing. In such implementations, an attachment component, such as a v-band clamp, may be used to physically and fluidly couple the first housing to the second housing. The first housing, the second housing, and the attachment component may be at a location that is not insulated where an upstream end of the second housing is coupled to a downstream end of the first housing. Thus, the attachment component may be exposed to increased heat transfer from the exhaust gas within the aftertreatment system. The increased heat to the attachment component can result in additional heat transfer to components near to the attachment component, such as the sensor assemblies and/or sensor table, via radiative heat transfer, convective heat transfer, and/or conductive heat transfer. Such added heat transfer may increase the temperature of the sensor assemblies to exceed an operational temperature and/or otherwise adversely affect the operation of the sensor assemblies. Accordingly, reducing the radiative heat transfer, convective heat transfer, and/or conductive heat transfer may be useful to maintain the sensor assemblies within an operational or preferred temperature range.

However, in some implementations, the attachment component, such as the v-band clamp, may be configured to permit servicing of the aftertreatment component and/or components therein, such as replacement of a catalyst and/or filter positioned within the first and/or second housing. Accordingly, a radiation shield may be coupled to one of the first or second housing to reduce radiative heat transfer to the sensor assemblies by absorbing and/or redirecting the radiating heat energy away from the sensor assemblies. In some implementations, the radiation shield may also be offset from the housing and/or attachment member to provide an air gap to reduce convective heat transfer. The radiation shield includes an attachment portion and a thermal barrier portion. The attachment portion couples the radiation shield to one of an exterior of an exterior of the first housing or an exterior of the second housing. The thermal barrier portion diverts radiative thermal energy in a direction different than a source direction of the radiative thermal energy, such as away from the sensor assemblies of the aftertreatment system.

II. Overview of Aftertreatment System

FIG. 1 depicts an aftertreatment system 100 having an example reductant delivery system 110 for an exhaust system 190. The aftertreatment system 100 includes a particulate filter, for example a diesel particulate filter (DPF) 102, the reductant delivery system 110, a decomposition chamber or reactor pipe 104, a SCR catalyst 106, and a sensor 150.

The DPF 102 is configured to remove particulate matter, such as soot, from exhaust gas flowing in the exhaust system 190. The DPF 102 includes an inlet, where the exhaust gas is received, and an outlet, where the exhaust gas exits after having particulate matter substantially filtered from the exhaust gas and/or converting the particulate matter into carbon dioxide.

The decomposition chamber 104 is configured to convert a reductant, such as urea or diesel exhaust fluid (DEF), into ammonia. The decomposition chamber 104 includes a reductant delivery system 110 having a doser 112 configured to dose the reductant into the decomposition chamber 104. In some implementations, the reductant is injected upstream of the SCR catalyst 106. The reductant droplets then undergo the processes of evaporation, thermolysis, and hydrolysis to form gaseous ammonia within the exhaust system 190. The decomposition chamber 104 includes an inlet in fluid communication with the DPF 102 to receive the exhaust gas containing $NO_x$ emissions and an outlet for the exhaust gas, $NO_x$ emissions, ammonia, and/or remaining reductant to flow to the SCR catalyst 106.

The decomposition chamber 104 includes the doser 112 mounted to the decomposition chamber 104 such that the doser 112 may dose the reductant into the exhaust gases flowing in the exhaust system 190. The doser 112 may include an insulator 114 interposed between a portion of the doser 112 and the portion of the decomposition chamber 104 to which the doser 112 is mounted. The doser 112 is fluidly coupled to one or more reductant sources 116. In some implementations, a pump 118 may be used to pressurize the reductant from the reductant source 116 for delivery to the doser 112.

The doser 112 and pump 118 are also electrically or communicatively coupled to a controller 120. The controller 120 is configured to control the doser 112 to dose reductant into the decomposition chamber 104. The controller 120 may also be configured to control the pump 118. The controller 120 may include a microprocessor, an application-specific integrated circuit (ASIC), a field-programmable gate array (FPGA), etc., or combinations thereof. The controller 120 may include memory which may include, but is not limited to, electronic, optical, magnetic, or any other storage or transmission device capable of providing a processor, ASIC, FPGA, etc. with program instructions. The memory may include a memory chip, Electrically Erasable Programmable Read-Only Memory (EEPROM), erasable programmable read only memory (EPROM), flash memory, or any other suitable memory from which the controller 120 can read instructions. The instructions may include code from any suitable programming language.

The SCR catalyst 106 is configured to assist in the reduction of $NO_x$ emissions by accelerating a $NO_x$ reduction process between the ammonia and the $NO_x$ of the exhaust gas into diatomic nitrogen, water, and/or carbon dioxide. The SCR catalyst 106 includes an inlet in fluid communication with the decomposition chamber 104 from which exhaust gas and reductant is received and an outlet in fluid communication with an end of the exhaust system 190.

The exhaust system 190 may further include an oxidation catalyst, for example a diesel oxidation catalyst (DOC), in fluid communication with the exhaust system 190 (e.g., downstream of the SCR catalyst 106 or upstream of the DPF 102) to oxidize hydrocarbons and carbon monoxide in the exhaust gas.

In some implementations, the DPF 102 may be positioned downstream of the decomposition chamber or reactor pipe 104. For instance, the DPF 102 and the SCR catalyst 106 may be combined into a single unit, such as a DPF with SCR-coating (SDPF). In some implementations, the doser 112 may instead be positioned downstream of a turbocharger or upstream of a turbocharger.

The sensor 150 may be coupled to the exhaust system 190 to detect a condition of the exhaust gas flowing through the exhaust system 190. In some implementations, the sensor 150 may have a portion disposed within the exhaust system 190, such as a tip of the sensor 150 may extend into a portion of the exhaust system 190. In other implementations, the sensor 150 may receive exhaust gas through another conduit, such as a sample pipe extending from the exhaust system 190. While the sensor 150 is depicted as positioned downstream of the SCR catalyst 106, it should be understood that the sensor 150 may be positioned at any other position of the exhaust system 190, including upstream of the DPF 102, within the DPF 102, between the DPF 102 and the decomposition chamber 104, within the decomposition chamber 104, between the decomposition chamber 104 and the SCR catalyst 106, within the SCR catalyst 106, or downstream of the SCR catalyst 106. In addition, two or more sensors 150 may be utilized for detecting a condition of the exhaust gas, such as two, three, four, five, or six (or more) sensors 150, with each sensor 150 located at one of the foregoing positions of the exhaust system 190.

III. Example Radiation Shield for Aftertreatment System

Figure 2:
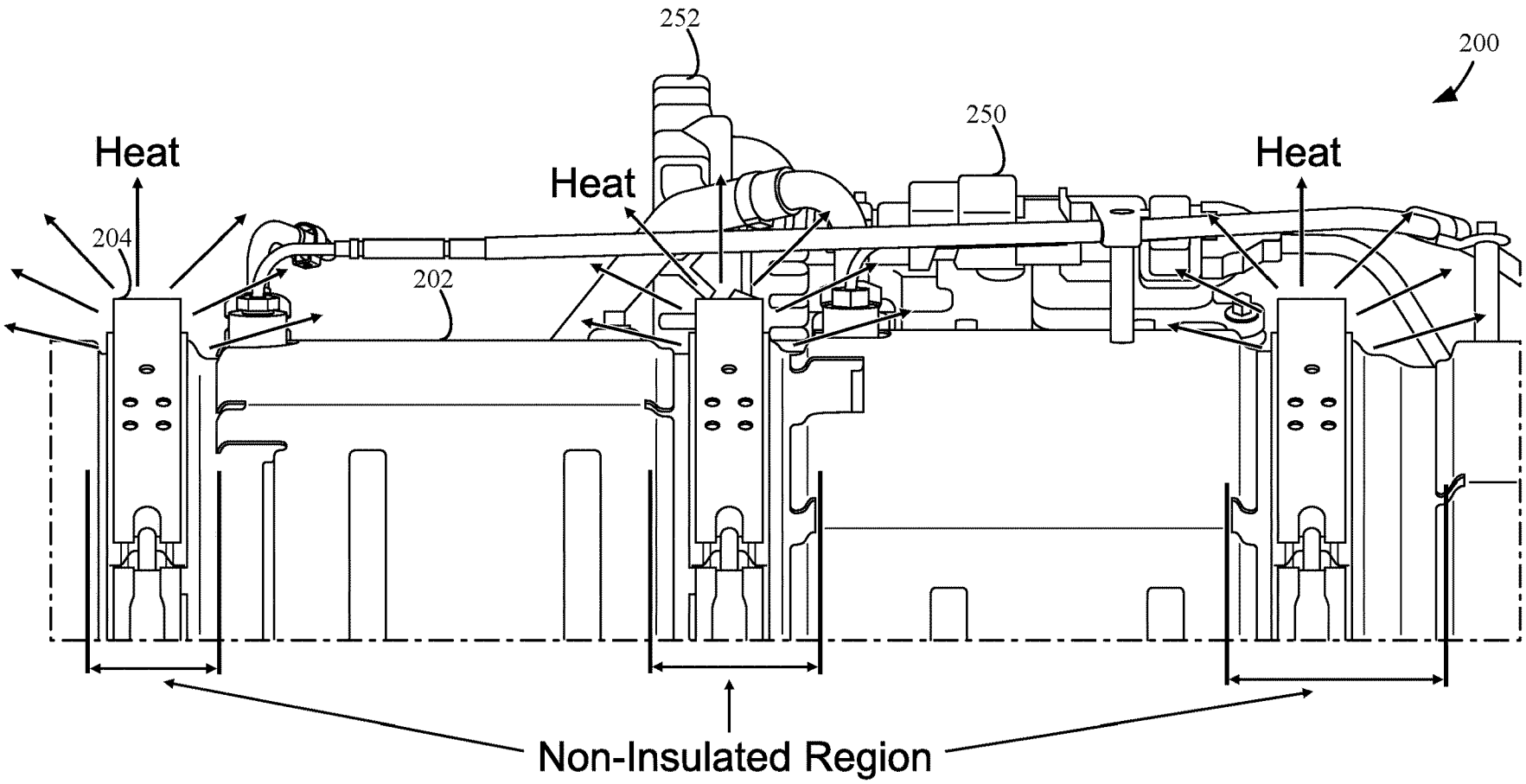
FIG. 2 is a side elevation view of an implementation of an aftertreatment system having several housings coupled together with v-band clamps.

Aftertreatment systems can be subjected to high heat due to the temperature of exhaust flowing therein. An aftertreatment system 200 can include a sensor assembly 250 and/or a sensor table with a sensor assembly mounted thereto, such as that shown in FIG. 2, that is coupled to an exterior of a housing 202 of the aftertreatment system 200. In some implementations, the aftertreatment system 200 can be a single module aftertreatment system. The sensor assembly 250 can include one or more sensors 252, such as a differential/delta pressure (dP) sensor, an exhaust gas temperature sensor, a nitrogen oxide ($NO_x$) sensor, and/or a particulate matter (PM) sensor. Failure of the sensor components, such as due to exceeding an operational or preferred temperature range, may lead to reduced system performance and expected down time for service and repair. As shown in FIG. 2, heat can emanate from an attachment component 204 or other locations of the aftertreatment system 200 that are not insulated. The non-insulated regions at the attachment component 204 locations are a known source of heat during system operation. This heat is transferred to the surrounding components and space claim in the form of radiation.

Figure 3:
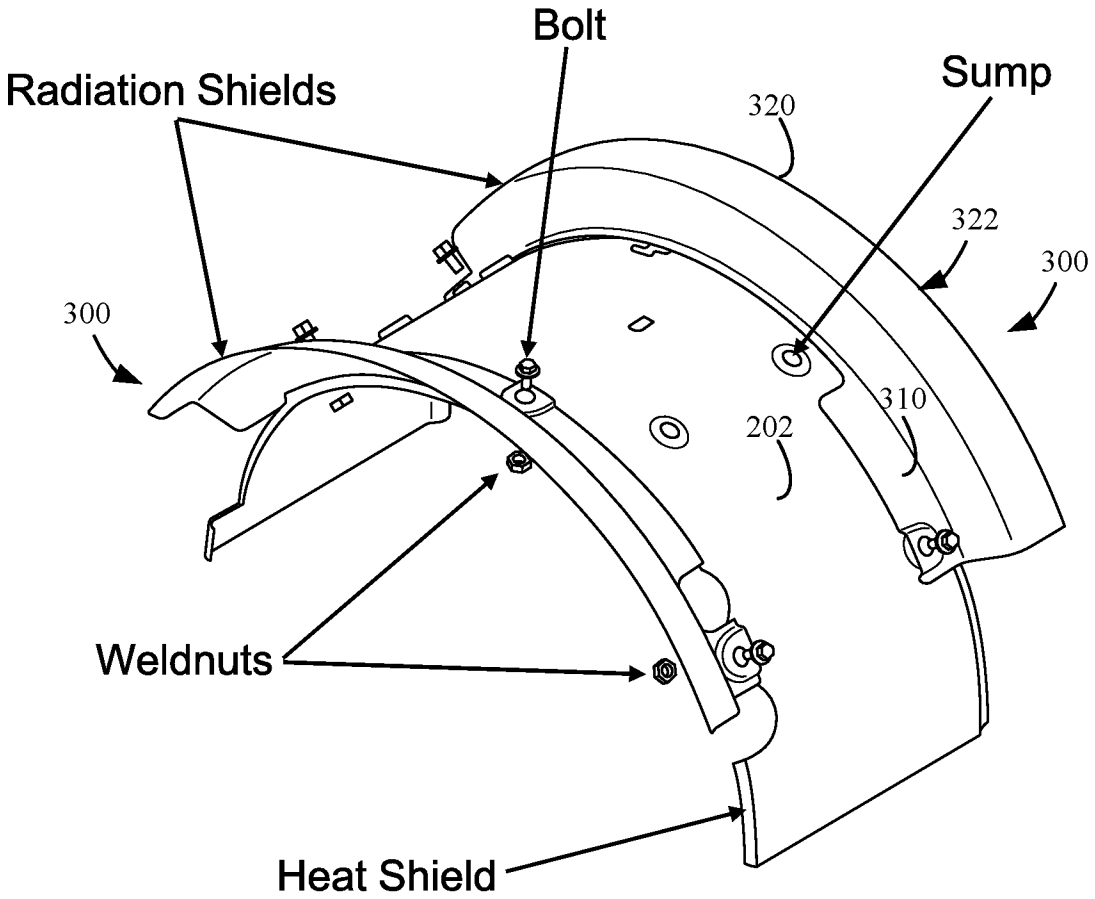
FIG. 3 is a perspective view of a portion of a housing having two radiation shields coupled thereto at an upstream end and a downstream end.

To protect the sensor components on the aftertreatment system 200 against failure due to excessive heat transfer, a radiation shield 300, such as that shown in FIG. 3, may be provided at locations of the aftertreatment system 200 from where radiative thermal energy emanates, such as non-insulated joints. The radiation shield 300 can be an arched or curved component that is externally fixed to the aftertreatment system 200. As shown in FIG. 3, the radiation shield 300 can be coupled to an exterior of a housing 204 of the aftertreatment system 200 via a bolt and weld nuts. In other implementations, the radiation shield 300 may be integrally formed with the housing 202 and/or a heat shield of the housing 202. In some other implementations, the radiation shield 300 may be welded to the housing 202 and/or the heat shield of the housing 202. The radiation shield 300 may be a stamped sheet metal component or may be formed of a thermally absorptive material. In some implementations, the radiation shield 300 may include infrared reflective coating.

Figure 4:
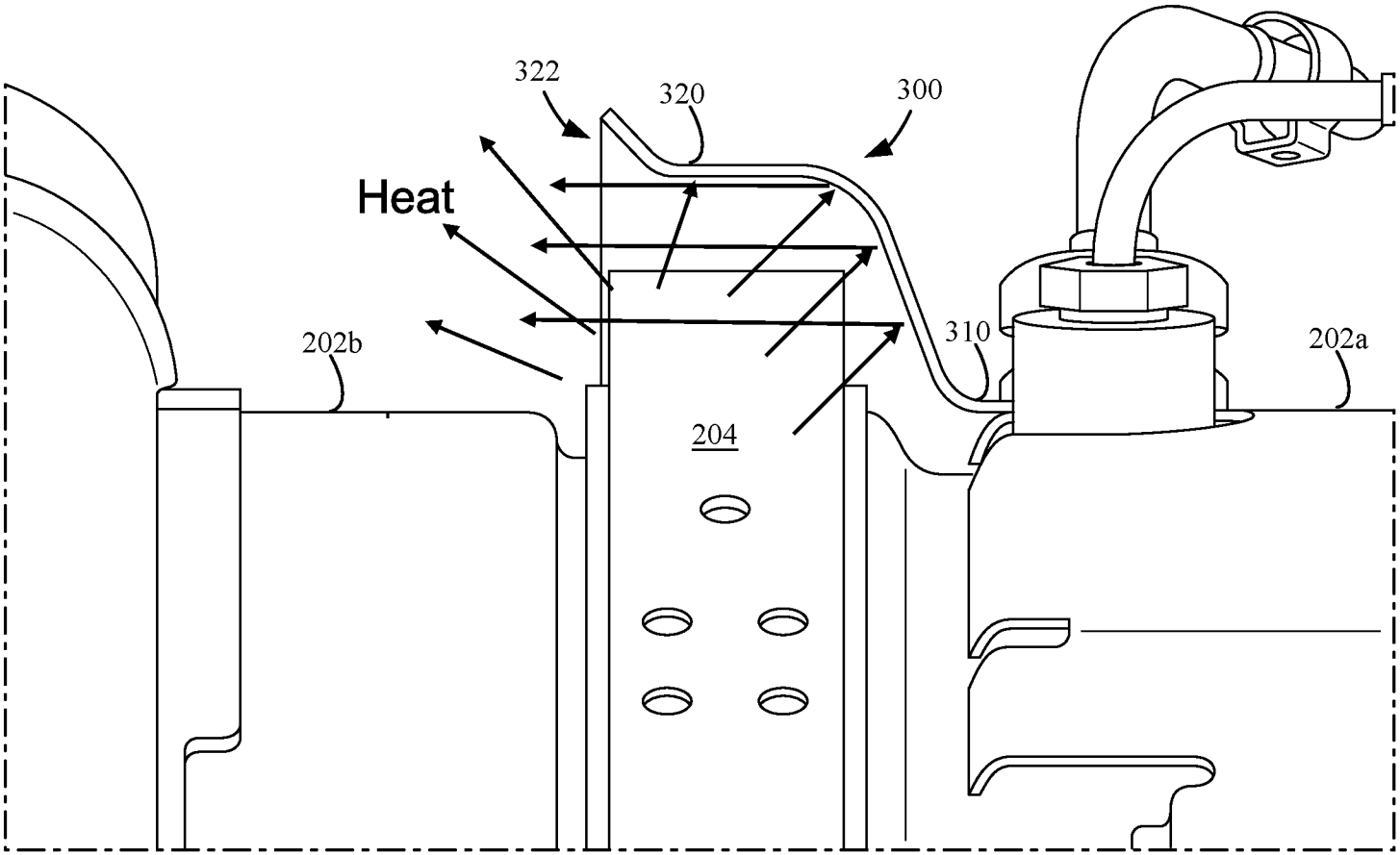
FIG. 4 is a partial side cross-sectional view of an implementation of a radiation shield and FIG. 5 is a side elevation view of an implementation of an aftertreatment system having housings coupled together with v-band clamps and with radiation shields.
Figure 5:
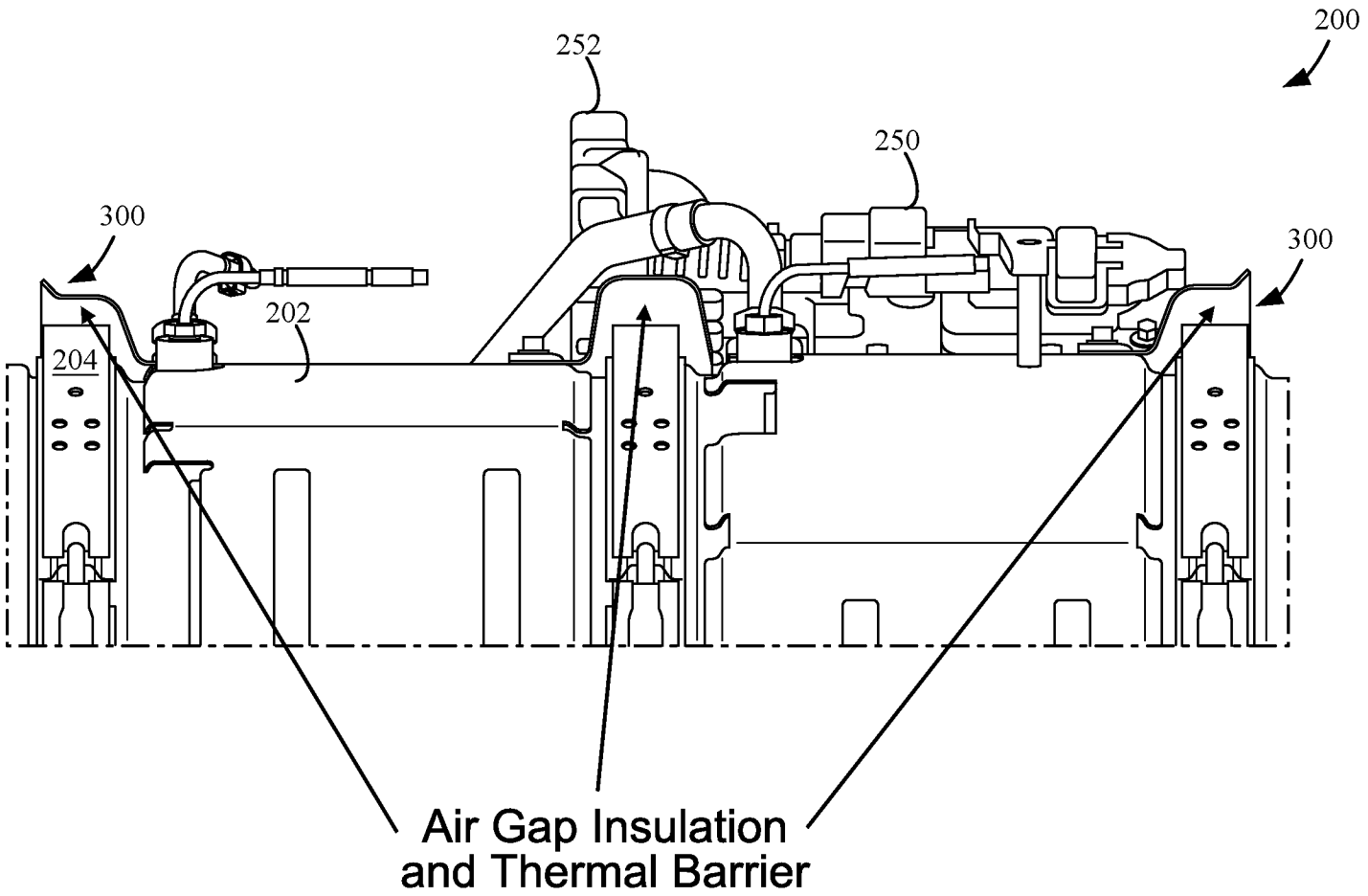

As shown in FIG. 3, the radiation shield 300 includes an attachment portion 310 for coupling to the housing 202 and/or heat shield of the housing 202 and a thermal barrier portion 320. The thermal barrier portion 320 includes a flared opening geometry or open end 322 opposite the attachment portion 310 when the attachment portion 310 is coupled to the exterior of the housing 202. As shown in FIG. 4, the flared opening geometry 322 of the radiation shield 300 redirects radiative thermal energy that is emitted from an attachment component 204 at a non-insulated joint, such as a v-band clamp, away from the sensors and outwards to dissipate. Moreover, as shown in FIG. 5, the thermal barrier portion 320 is offset from the exterior of the housing 202 to form an air gap insulation volume. The air gap insulation volume provides a convective thermal barrier to further reduce heat transfer to the sensor assembly 250. Such radiation shields 300 maintain serviceability of components within the aftertreatment system 200, such as a catalyst or filter, while strategically allowing thermal energy from the aftertreatment system 200 to be redirected to atmosphere to dissipate.

Because thermal energy follows a path of least resistance, if a complete heat shield or wrap is implemented, then other uninsulated components, such as a doser, may be the next path of least resistance and would have the thermal energy transferred to those other uninsulated components. Accordingly, the presently described radiation shield 300 is configured to allow a path of least resistance for the thermal energy to a dissipative area while shielding the sensors 252 and not transferring the thermal energy to other uninsulated components. The radiation shield 300 mounts to a housing

202 and/or to a subassembly heat shield and has a geometry and is oriented such that the radiation shield 300 provides an air gap and physical thermal barrier to the sensor assembly 250. In addition, the radiation shield 300 described herein permits ease of serviceability of aftertreatment components housed within the aftertreatment system 200, such as a filter, catalyst, compact mixer, etc.

An aftertreatment system 200 implementing the radiation shield 300 described herein includes a first housing 202*a*, a second housing 202*b*, and a radiation shield 300. The aftertreatment system 200 may also include a first aftertreatment component. The first housing 202*a* has a first upstream end and a first downstream end and defines a first interior volume. The second housing 202*b* has a second upstream end and a second downstream end and defines a second interior volume. The second upstream end is coupled to the first downstream end of the first housing 202*a* to fluidly couple the first interior volume to the second interior volume. The radiation shield 300 includes an attachment portion 310 and a thermal barrier portion 320. The attachment portion 310 is coupled to at least one of an exterior of the first housing 202*a* or an exterior of the second housing 202*b*. The thermal barrier portion 320 diverts radiative thermal energy in a second direction different than a source direction of the radiative thermal energy. In some instances, the first aftertreatment component positioned within one of the first interior volume of the first housing 202*a* or the second interior volume of the second housing 202*b*. A second aftertreatment component may be positioned within the other of the first interior volume of the first housing 202*a* or the second interior volume of the second housing 202*b*.

The thermal barrier portion 320 can include an open end opposite the attachment portion 310 when the attachment portion 310 is coupled to the at least one of an exterior of the first housing or an exterior of the second housing. In some implementations, the second upstream end of the second housing is coupled to the first downstream end of the first housing by a v-band clamp. The radiative thermal energy may be emitted by the v-band clamp. In some instances, the first housing 202*a* and the second housing 202*b* are not insulated at a location where the second upstream end of the second housing 202*b* is coupled to the first downstream end of the first housing 202*a*. The aftertreatment system 200 may also include a sensor assembly 250 mounted to at least one of the first housing 202*a* and the second housing 202*b* and the second direction for the diverted radiative thermal energy is away from the sensor assembly 250. The thermal barrier portion 320 may include an open end opposite the attachment portion 310 when the attachment portion 310 is coupled to the at least one of an exterior of the first housing 202*a* or an exterior of the second housing 202*b* and the open end opens away from the sensor assembly 250. In some instances, the thermal barrier portion 320 is offset from at least one of an exterior of the first housing 202*a* or an exterior of the second housing 202*b* to form an air gap insulation volume. In some instances, the first housing 202*a*, the second housing 202*b*, the first aftertreatment component, and the radiation shield 300 are part of a single module aftertreatment system. In some instances, the first aftertreatment component is positioned within the first interior volume of the first housing 202*a* and the attachment portion 310 of the radiation shield 300 is coupled to the exterior of the first housing 202*a*.

In some implementations, the aftertreatment system 200 can include four housings 202 and three attachment components 204. The radiation shields 300 can be formed to fit a contour of an external heat shield and be attached to formed sumps with bolts and nuts at two or more locations. This non-invasive temperature reducing solution also allows for removal during system service events. In some implementations, the radiation shield 300 can be further modified. For instance, the geometry of the flared edges can be optimized such as to increase dissipation of thermal energy (e.g., via heat sink fins, etc.). In some instances, the structural rigidity of the radiation shield 300 may be increased via strengthening ribs. In some implementations, a high thermal resistance coating may be applied to an interior surface of the thermal barrier portion 320.

The term "controller" encompasses all kinds of apparatus, devices, and machines for processing data, including by way of example a programmable processor, a computer, a system on a chip, or multiple ones, a portion of a programmed processor, or combinations of the foregoing. The apparatus can include special purpose logic circuitry, e.g., an FPGA or an ASIC. The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as distributed computing and grid computing infrastructures.

While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

As utilized herein, the term "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled" and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

The terms "fluidly coupled," "in fluid communication," and the like as used herein mean the two components or objects have a pathway formed between the two components or objects in which a fluid, such as water, air, gaseous reductant, gaseous ammonia, etc., may flow, either with or without intervening components or objects. Examples of fluid couplings or configurations for enabling fluid communication may include piping, channels, or any other suitable components for enabling the flow of a fluid from one component or object to another.

It is important to note that the construction and arrangement of the system shown in the various exemplary implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An aftertreatment system comprising:

a first housing having a first upstream end and a first downstream end and defining a first interior volume;

a second housing having a second upstream end and a second downstream end and defining a second interior volume, the second upstream end coupled to the first downstream end of the first housing to fluidly couple the first interior volume to the second interior volume;

a first aftertreatment component positioned within at least one of the first interior volume of the first housing or the second interior volume of the second housing; and a radiation shield comprising an attachment portion and a thermal barrier portion, the attachment portion coupled to an exterior of the first housing, the thermal barrier portion extending circumferentially around a portion of the second housing, the thermal barrier portion having a flared opening geometry structured to divert radiative thermal energy in a second direction different than a source direction of the radiative thermal energy.

2. The aftertreatment system of claim 1, wherein the thermal barrier portion comprises an open end opposite the attachment portion.

3. The aftertreatment system of claim 1, wherein the second upstream end of the second housing is coupled to the first downstream end of the first housing by a v-band clamp.

4. The aftertreatment system of claim 3, wherein the radiative thermal energy is emitted by the v-band clamp.

5. The aftertreatment system of claim 1, wherein the first housing and the second housing are not insulated at a location where the second upstream end of the second housing is coupled to the first downstream end of the first housing.

6. The aftertreatment system of claim 1 further comprising a sensor assembly mounted to at least one of the first housing or the second housing, wherein the second direction for the diverted radiative thermal energy is away from the sensor assembly.

7. The aftertreatment system of claim 6, wherein the thermal barrier portion comprises an open end opposite the attachment portion, wherein the open end opens away from the sensor assembly.

8. The aftertreatment system of claim 1, wherein the thermal barrier portion is offset from at least one of an exterior of the first housing or an exterior of the second housing, to form an air gap insulation volume.

9. The aftertreatment system of claim 1, wherein the first housing, the second housing, the first aftertreatment component, and the radiation shield are part of a single module aftertreatment system.

10. The aftertreatment system of claim 1, wherein the first aftertreatment component is positioned within the first interior volume of the first housing and the attachment portion of the radiation shield is coupled to the exterior of the first housing.

11. An apparatus comprising:

an aftertreatment system having a housing; and a radiation shield having an attachment portion and a thermal barrier portion, the attachment portion coupled to an exterior of the housing, the thermal barrier portion having an outwardly flared opening portion structured to divert radiative thermal energy in a second direction different than a source direction of the radiative thermal energy.

12. The apparatus of claim 11, wherein the aftertreatment system comprises an aftertreatment component positioned within an interior volume of the housing.

13. The apparatus of claim 11, wherein the thermal barrier portion comprises an open end opposite the attachment portion.

14. The apparatus of claim 11, wherein the aftertreatment system comprises an attachment component, wherein the attachment component emits at least part of the radiative thermal energy.

15. The apparatus of claim 14, wherein the attachment component is a v-band clamp.

16. The apparatus of claim 11 further comprising a sensor assembly mounted to the housing, wherein the second direction for the diverted radiative thermal energy is away from the sensor assembly.

17. The apparatus of claim 11, wherein the thermal barrier portion is offset from the housing to form an air gap insulation volume.

18. An aftertreatment system comprising:

a first housing;

a second housing coupled to the first housing via an attachment component;

a first aftertreatment component positioned within at least one of the first housing or the second housing; and a radiation shield comprising an attachment portion and a thermal barrier portion, the attachment portion coupled to at least one of an exterior of the first housing or an exterior of the second housing, the thermal barrier portion having an outwardly flared opening portion structured to divert radiative thermal energy in a second direction different than a source direction of the radiative thermal energy.

19. The aftertreatment system of claim 18, wherein the thermal barrier portion comprises an open end opposite the attachment portion.

20. The aftertreatment system of claim 18, wherein the first housing, the second housing, the first aftertreatment component, and the radiation shield are part of a single module aftertreatment system.

* * * * *